US008238598B2

(12) United States Patent
Lee

(10) Patent No.: US 8,238,598 B2
(45) Date of Patent: Aug. 7, 2012

(54) SOUND SYSTEM OF WALL MOUNTED FLAT PANEL DISPLAY APPARATUS

(75) Inventor: Yeon-Ho Lee, Gyeonggi-do (KR)

(73) Assignee: Sungkyunkwan University Foundation for Corporate Collaboration, Gyeonggi-Do (KR)

( * ) Notice: Subject to any disclaimer, the term of this patent is extended or adjusted under 35 U.S.C. 154(b) by 751 days.

(21) Appl. No.: 12/354,597

(22) Filed: Jan. 15, 2009

(65) Prior Publication Data

US 2009/0196455 A1 Aug. 6, 2009

(30) Foreign Application Priority Data

Jan. 17, 2008 (KR) ..... 10-2008-0005160

(51) Int. Cl.
*H04R 25/00* (2006.01)

(52) U.S. Cl. ..... 381/388; 381/152

(58) Field of Classification Search ..... 381/152, 381/388
See application file for complete search history.

(56) References Cited

U.S. PATENT DOCUMENTS

| | | | | |
|---|---|---|---|---|
| 7,164,576 | B2 * | 1/2007 | Suprapmo et al. | 361/679.55 |
| 7,654,362 | B2 * | 2/2010 | Suzuki et al. | 181/153 |
| 2002/0172002 | A1 * | 11/2002 | Sasaki et al. | 361/683 |
| 2009/0034759 | A1 * | 2/2009 | Ko et al. | 381/152 |

* cited by examiner

*Primary Examiner* — Phuc Dang
(74) *Attorney, Agent, or Firm* — James P. Muraff; Neil, Gerber & Eisenberg LLP

(57) ABSTRACT

In accordance with an embodiment of the present invention, a sound system of a wall-mounted flat panel display apparatus can include a speaker, being mounted in an area except for a display area, which plays back a video, in the flat panel display apparatus and playing back a corresponding sound; and an acoustic resonator, having a box shape including one surface formed with an open area and being mounted such that the surface formed with the open area is closely in contact with an outer side of a case of the flat panel display apparatus, the acoustic resonator being configured to induce a resonance of a sound projected from the speaker and inputted through the open area. With the present invention, it can be possible to adequately improve audio balance by simply mounting a pipe or box shaped acoustic resonator in an outer side of a case of the flat panel display apparatus.

34 Claims, 18 Drawing Sheets
(2 of 18 Drawing Sheet(s) Filed in Color)

LEFT: None
RIGHT: 110cm Pipe Resonator at the back of LCD

SOUND SYSTEM OF WALL MOUNTED FLAT PANEL DISPLAY APPARATUS

CROSS-REFERENCE TO RELATED APPLICATIONS

This application claims the benefit of Korean Patent Application No. 10-2008-0005160 filed with the Korean Intellectual Property Office on Jan. 17, 2008, the disclosure of which is incorporated herein by reference in its entirety.

BACKGROUND

1. Technical Field

The present invention relates to a sound system, more specifically to a sound system of a wall-mounted flat panel display apparatus.

2. Description of the Related Art

Flat panel display apparatuses such as televisions and monitors employing LCD, PDP, or OLED has been popular because of not only their clearer video quality but also their less-occupied space due to the thin thickness as compared with CRT-type display apparatuses. In particular, wall-mounted flat panel display apparatuses can be easily mounted in a wall through a simple mounting means. This can permit us to use more-widened space efficiently when we watch a TV, for example.

The sound outputted from a wall-mounted flat panel display apparatus, however, encounter several obstacles on its way. In particular, high-frequency sounds may be over-amplified or distorted by the obstacles and mid or low-frequency sounds may be weakened. This is because the wall-mounted flat panel apparatus has its own weak properties in sound output and its restriction in mounted structure. This will be described with reference to FIG. 1A through FIG. 1C.

Firstly, the weakness in the output sound is caused by the inherent problem of typical flat panel display apparatuses. Referring to FIG. 1A, a flat panel display apparatus 10 has a display area 11 for playing back a video, which occupies most of the area and volume of the whole flat panel display apparatus. This reflects the current trend of users who have some preference for wider screens.

Accordingly, in the flat display apparatus 10 there is little room for a sound system to amplify and play back the audio sound. In FIG. 1A, for example, front sound holes 13 and 13' with speaker units behind can be placed only in only narrow remaining areas.

Moreover, the flat panel display apparatus 10 is usually very thin in its thickness from the front side 12 to a back side 14 as compared with the conventional CRT type display apparatuses. In this condition there remains only a narrow physical space in which the sound system can be mounted. The narrow ambient space may cause poor sound quality especially in the low-frequency sound component.

Secondly, the weakness in the output sound of the wall-mounted flat panel display apparatus is caused by the mounting scheme in which the flat panel display apparatus is fixed very close to the wall.

FIG. 1B shows the top view of a flat panel display apparatus mounted on a wall. In most commercial design of the flat panel display apparatus, simple speaker drivers are used for its sound system without any speaker enclosures due to the limited space available inside the flat panel display apparatus. In this case the speaker drivers are tightly attached to the surface of the apparatus case. Therefore, the output sound from drivers of the speakers 20 and 20' can mostly propagate toward the front side 12. Here, these sounds are referred to as "front sounds." However, the mechanical vibration of the drivers inevitably produces audio sounds propagating toward the back side 14 of the flat panel display apparatus 10. Here, these sounds are referred to as "back sounds."

The back sounds can leave the flat panel display apparatus through holes formed at the back side 14, which may be formed for outputting the sound or other purposes such as ventilation. Then the back sounds can be reflected by the wall and directed toward the front. Since the back sounds are 180 degree out of phase with the front sounds, they may destructively interfere with the front sounds and significantly reduce the sound level. This can happen most effectively at a low-frequency sound having a long wavelength for which the path length difference between the front and the back sound of the wall mounted display apparatus produces a negligible phase change.

Thirdly, the wall mounted flat panel display apparatus can be almost hanging freely in the air because only a part of the back side 14 is in contact with the mounting bracket or post 15. This means that the flat panel display apparatus itself and its outer case are easy to vibrate mechanically by a small vibration of the wall or ambient air including audio sound waves. The mechanical vibration of the outer case, in turn, may interfere with the audio sound waves and deteriorate their spectral purity. For example, a sound wave of frequency 100 Hz represents a sinusoidal vibration of the air 100 times per second. When a mechanical vibration of the case interferes with the sound wave, the vibration of the sound wave will not be sinusoidal any more and the wave tends to contain other frequency components, from Fourier analysis, which act as noises. Unfortunately, this can happen all over the audio sound spectrum, from the high-frequency sound to the low-frequency sound, depending on the mechanical resonance of the case of the flat panel display apparatus.

When a sound wave of a certain frequency band is incident in a closed space, and the resonance condition is satisfied between the wavelength of the incident sound wave and the spatial dimension of the space, there occurs the resonance phenomenon of the sound wave, which rapidly increases the magnitude of the pertinent sound. Since the gap between the back side 14 of the flat panel display apparatus and the wall 19 in FIG. 1B is usually a few centimeters, high-frequency components of the output sound from the speakers 20 and 20' may satisfy the resonance condition and constructively interfere in the gap. In addition, the mounting means 15 can be usually made of metallic materials. Due to its mechanical property, a small vibration of the metallic mounting means 15 can easily interfere with the resonating high-frequency sound, in the reason explained above, and may produce an amplified metallic sound that gives harshness and uneasiness to the audience.

Such interference and resonance phenomenon phenomena may be the main source of distortion and noise in the sound wave. As described above, the wall-mounted flat panel display apparatus is more vulnerable to these problems. This is shown schematically in FIG. 1C, which shows that the flat panel display apparatus 10 includes a high-frequency speaker 20*a* for playing back high-frequency sounds and a mid and low-frequency speaker 20*b* for playing back mid and low-frequency sounds.

SUMMARY

Accordingly, the present invention provides to a sound system of a wall-mounted flat panel display apparatus that can have outstanding audio balance.

The present invention also provides to a sound system of a wall-mounted flat panel display apparatus that can output improved sounds by simply mounting an acoustic resonator in an outer side of a case of a flat panel display apparatus.

The present invention provides to a sound system of a wall-mounted flat panel display apparatus that can output improved sounds without any modification of good appearance of the flat panel display apparatus.

In addition, the present invention provides to a sound system of a wall-mounted flat panel display apparatus with its less-occupied space and low manufacturing cost.

An aspect of present invention features a sound system of wall-mounted flat panel display apparatus having an acoustic resonator, including a speaker, being mounted in an area except for a display area, which plays back a video, in the flat panel display apparatus and playing back a corresponding sound; and an acoustic resonator, having a box shape including one surface formed with an open area and being mounted such that the surface formed with the open area is closely in contact with an outer side of a case of the flat panel display apparatus, the acoustic resonator being configured to induce a resonance of a sound projected from the speaker and inputted through the open area.

Another aspect of present invention features a sound system of wall-mounted flat panel display apparatus having an acoustic resonator, including a speaker, being mounted in an area except for a display area, which plays back a video, in the flat panel display apparatus and playing back a corresponding sound; and an acoustic resonator, having a box-shaped appearance and being manufactured as one body with a case of the flat panel display apparatus, the acoustic resonator having one surface formed with an open area and the surface being in surface-contact with the case of the flat panel display apparatus, and the acoustic resonator being configured to induce a resonance of a sound projected from the speaker and inputted through the open area.

Here, the acoustic resonator can be placed in a back side of the flat panel display apparatus to induce a resonance of a back sound projected in a direction of the back side of the flat panel display apparatus.

The acoustic resonator can be placed in at least one of left, right, upper and lower sides of the flat panel display apparatus.

The acoustic resonator can be formed with a hole for allowing the resonating sound to leak, the hole being formed on a surface except for a surface opposite to the surface having the open area.

The acoustic resonator can have a hexahedral box-shape, and the hole can be formed in at least one of left, right, upper and lower surfaces of the flat panel display apparatus when viewed from the surface having the open area.

The acoustic resonator can have a rectangular parallelepiped shape, a horizontal or vertical length of the acoustic resonator can be longer than a distance spaced between a back side of the flat panel display apparatus and a wall on which the flat panel display apparatus is to be mounted.

If the case of the flat panel display apparatus is formed with a hole for allowing a sound, projected from the speaker and passing through an space of the flat panel display apparatus, to leak to an outside, the acoustic resonator can be mounted such that the open area covers the hole.

If the flat panel display apparatus includes at least two speakers that are mounted in different areas, the acoustic resonator can be separately mounted per speaker.

If the flat panel display apparatus includes at least two speakers that function as each independent sound channel, the acoustic resonator can be separately mounted per speaker.

Another aspect of present invention features a sound system of wall-mounted flat panel display apparatus having an acoustic resonator, including a speaker, being mounted in an area except for a display area, which plays back a video, in the flat panel display apparatus and playing back a corresponding sound; and an acoustic resonator, being manufactured in a pipe form having one end part that is open and the other end part that is closed and being mounted in an outer side of a case of the flat panel display apparatus, the acoustic resonator being configured to induce a resonance of a sound projected from the speaker and inputted through the open end part.

Another aspect of present invention features a sound system of wall-mounted flat panel display apparatus having an acoustic resonator, including a speaker, being mounted in an area except for a display area, which plays back a video, in the flat panel display apparatus and playing back a corresponding sound; and an acoustic resonator, being manufactured as one body with a case of the flat panel display apparatus and in a pipe form having one end part that is open and the other end part that is closed, and being configured to induce a resonance of a sound projected from the speaker and inputted through the open end part.

Here, the acoustic resonator can have placed in a back side of the flat panel display apparatus to induce a resonance of a back sound projected in a direction of the back side of the flat panel display apparatus.

The acoustic resonator can have placed in at least one of left, right, upper and lower sides of the flat panel display apparatus.

A distance between the one end part and the other end part of the acoustic resonator can be longer than a distance between a back side of the flat panel display apparatus and a wall on which the flat panel display apparatus is mounted.

The acoustic resonator can be mounted such that the open end part is most adjacent to the speaker.

If the case of the flat panel display apparatus is formed with a hole for allowing a sound, projected from the speaker and passing through a space of the flat panel display apparatus, to leak to an outside, the acoustic resonator can be mounted such that the open end part is most adjacent to the speaker.

If the flat panel display apparatus includes at least two speakers that are mounted in different areas, the acoustic resonator can be separately mounted per speaker.

If the flat panel display apparatus includes at least two speakers that function as each independent sound channel, the acoustic resonator can be separately mounted per speaker.

Yet another aspect of the present invention features a sound system of the wall-mounted flat panel display apparatus, including a speaker, being mounted in an area except for a display area, which plays back a video, in the flat panel display apparatus and playing back a corresponding sound; and a bracket cover, configured to prevent a sound projected from the speaker from being reflected by a mounting bracket, which fixes the flat panel display apparatus on a wall, by surrounding the mounting bracket.

Here, the bracket cover can be manufactured such that a height of the bracket cover is equal to a distance between a back side of the flat panel display apparatus and the wall.

The bracket cover can be mounted in a space between a back side of the flat panel display apparatus and the wall to surround the mounting bracket.

The bracket cover can be manufactured to have a gated shape, in which one part of the bracket cover is coupled to the other parts by a hinge, allowing the one part to open and close in the overall bracket cover The bracket cover can be manufactured to have a partially-open shape, in which a portion of the surrounding of the mounting bracket is open. At this time, if the flat-panel display apparatus includes a high-frequency sound, the bracket cover can be mounted to allow the open portion to be placed most distantly from the high-frequency speaker.

The bracket cover can be made of a nonmetallic material.

The bracket cover can be manufactured as one body with a case of the flat panel display apparatus.

BRIEF DESCRIPTION OF THE DRAWINGS

The file of this patent contains two drawings executed in color. Copies of this patent with the color drawing will be provided by the Patent and Trademark Office upon request and payment of the necessary fee.

DETAIL DESCRIPTION

Figure 1A:
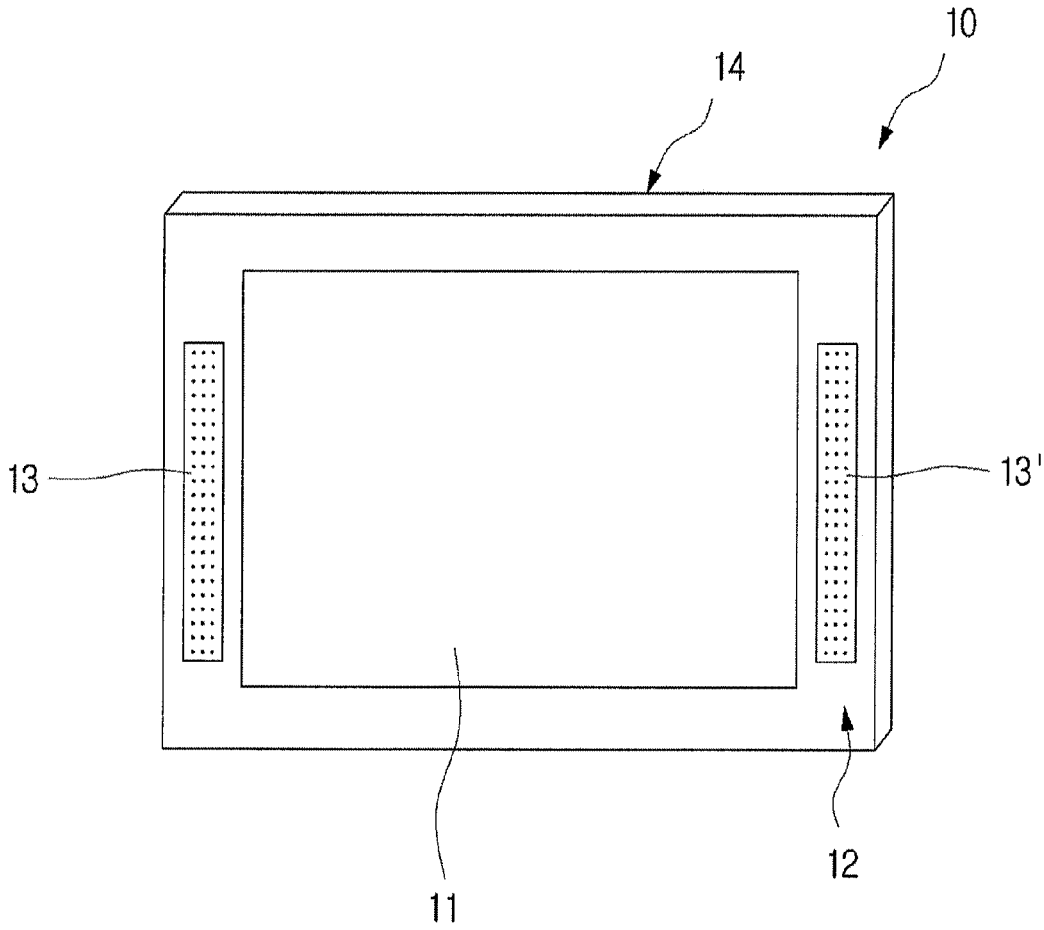
FIG. 1A shows briefly an appearance of a flat panel display apparatus.

Since there can be a variety of permutations and embodiments of the present invention, certain embodiments will be illustrated and described with reference to the accompanying drawings. This, however, is by no means to restrict the present invention to certain embodiments, and shall be construed as including all permutations, equivalents and substitutes covered by the spirit and scope of the present invention. Throughout the drawings, similar elements are given similar reference numerals. Throughout the description of the present invention, when describing a certain technology is determined to evade the point of the present invention, the pertinent detailed description will be omitted.

Terms such as "first" and "second" can be used in describing various elements, but the above elements shall not be restricted to the above terms. The above terms are used only to distinguish one element from the other. For instance, the first element can be named the second element, and vice versa, without departing the scope of claims of the present invention. The term "and/or" shall include the combination of a plurality of listed items or any of the plurality of listed items.

The terms used in the description are intended to describe certain embodiments only, and shall by no means restrict the present invention. Unless clearly used otherwise, expressions in the singular number include a plural meaning. In the present description, an expression such as "comprising" or "consisting of" is intended to designate a characteristic, a number, a step, an operation, an element, a part or combinations thereof, and shall not be construed to preclude any presence or possibility of one or more other characteristics, numbers, steps, operations, elements, parts or combinations thereof.

Unless otherwise defined, all terms, including technical terms and scientific terms, used herein have the same meaning as how they are generally understood by those of ordinary skill in the art to which the invention pertains. Any term that is defined in a general dictionary shall be construed to have the same meaning in the context of the relevant art, and, unless otherwise defined explicitly, shall not be interpreted to have an idealistic or excessively formalistic meaning.

In addition, when a sound is described as being "projected in any one direction," it shall be construed not only as being directly projected toward the direction but also as possibly being re-projected toward the direction by allowing the sound that has been projected toward another direction to be reflected on an element placed on its way.

Hereinafter, some embodiments of the present invention will be described in detail with reference to the accompanying drawings. However, the description of a sound system or a sound device that is originally mounted in a flat panel display apparatus will be omitted. It is because that the present invention features an acoustic resonator which is mounted in an outer side of a case of the flat panel display apparatus, in addition to the sound device that is originally mounted in the flat panel display apparatus.

Figure 1B:
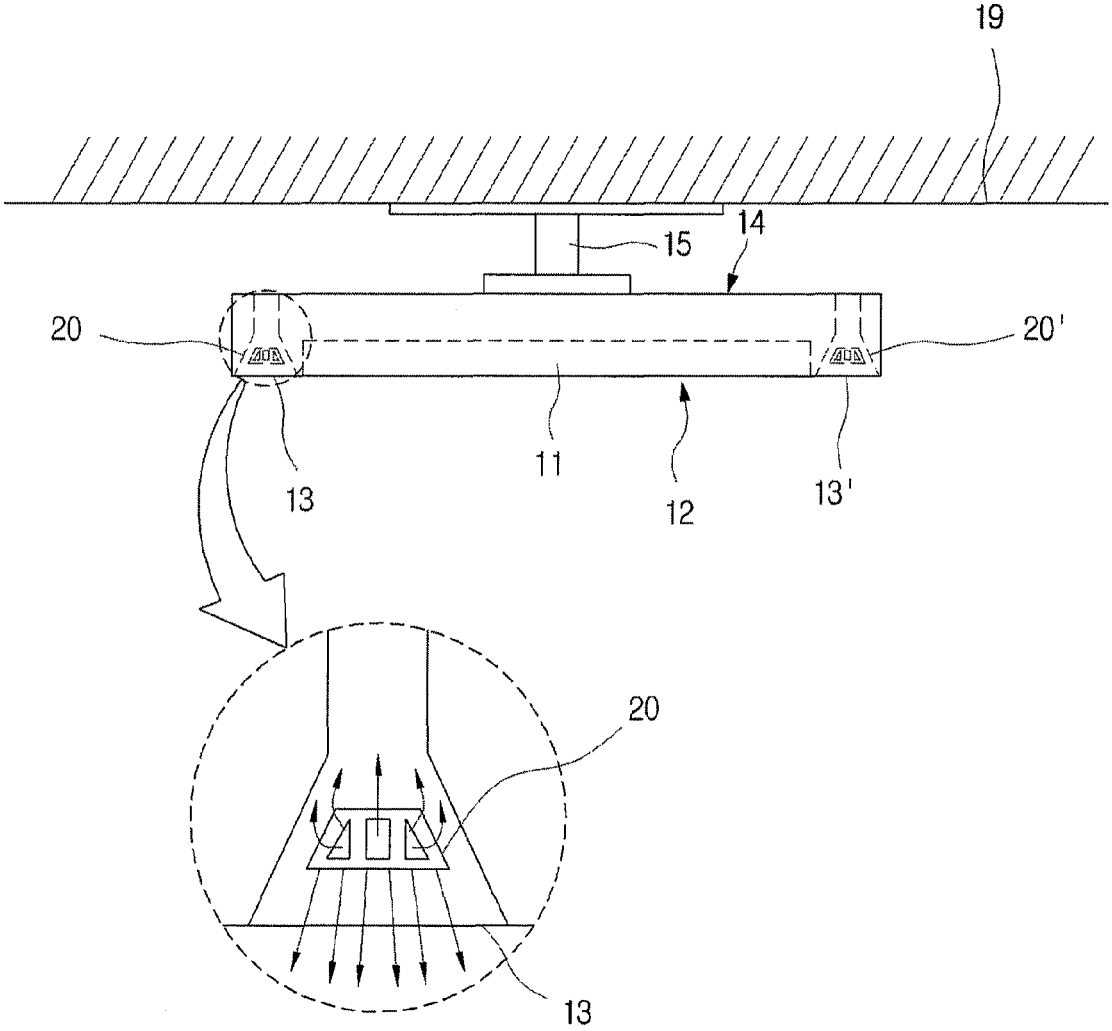
FIG. 1B is an example showing where speakers are placed when a wall mounted flat panel display apparatus is viewed from the above and how a sound is outputted from the speakers.
Figure 1C:
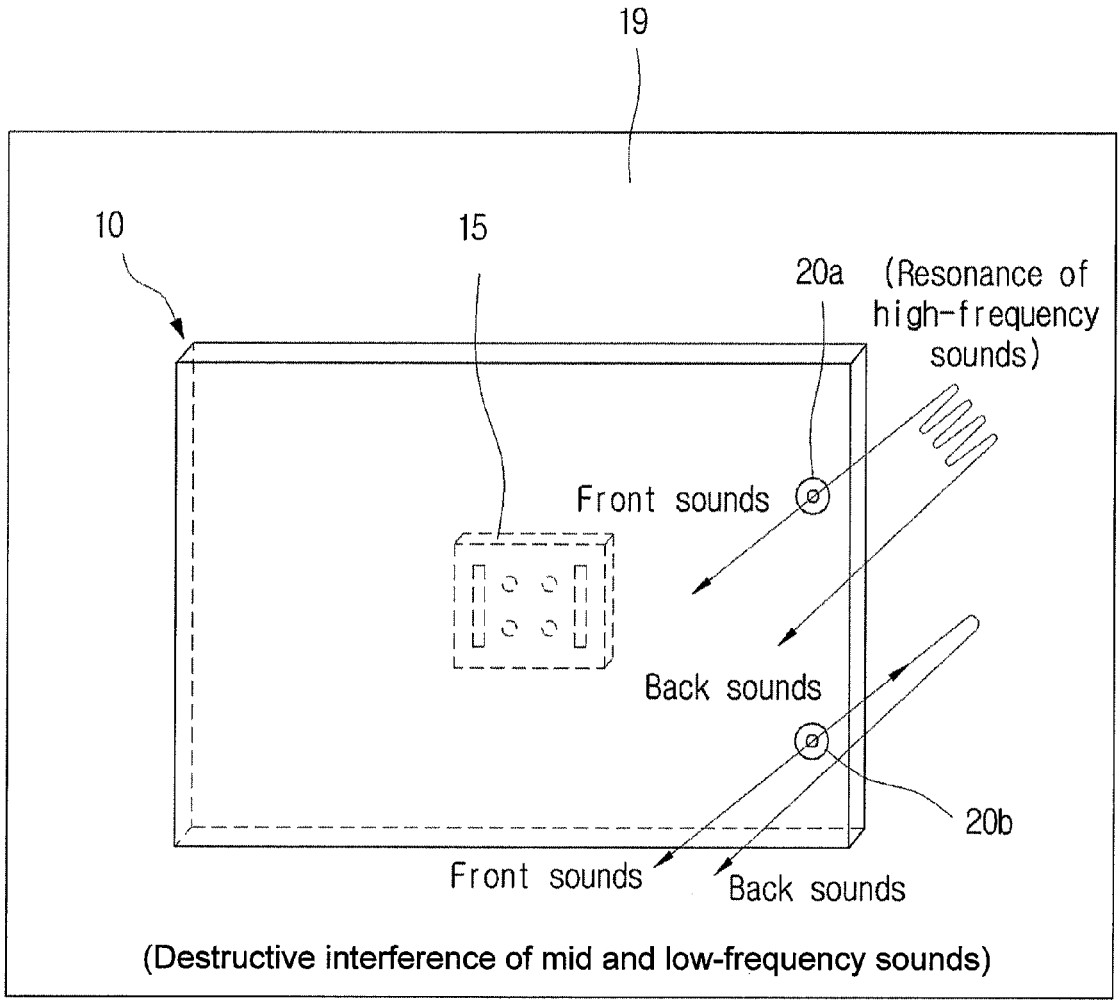
FIG. 1C is an example showing the difficulty for the conventional wall-mounted flat panel display apparatus in controlling the balance of the audio sound.

In the present invention, the sound device that is originally mounted in the flat panel display apparatus is substantially identical or similar to that of a typical flat panel display apparatus as shown in FIG. 1A and FIG. 1B.

Figure 2:
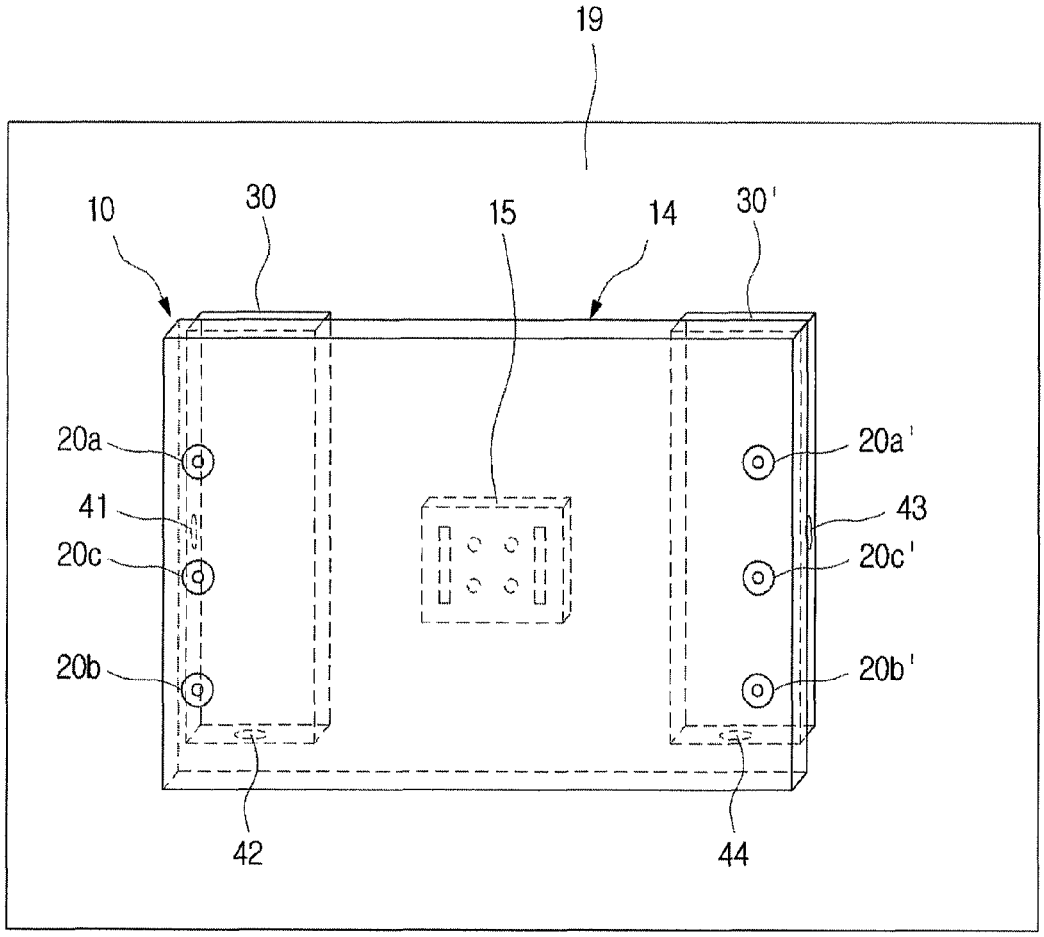
FIG. 2 is a perspective view showing briefly a sound system of a wall-mounted flat panel display apparatus having a box-shaped acoustic resonator in a first embodiment of the present invention.
Figure 3A:
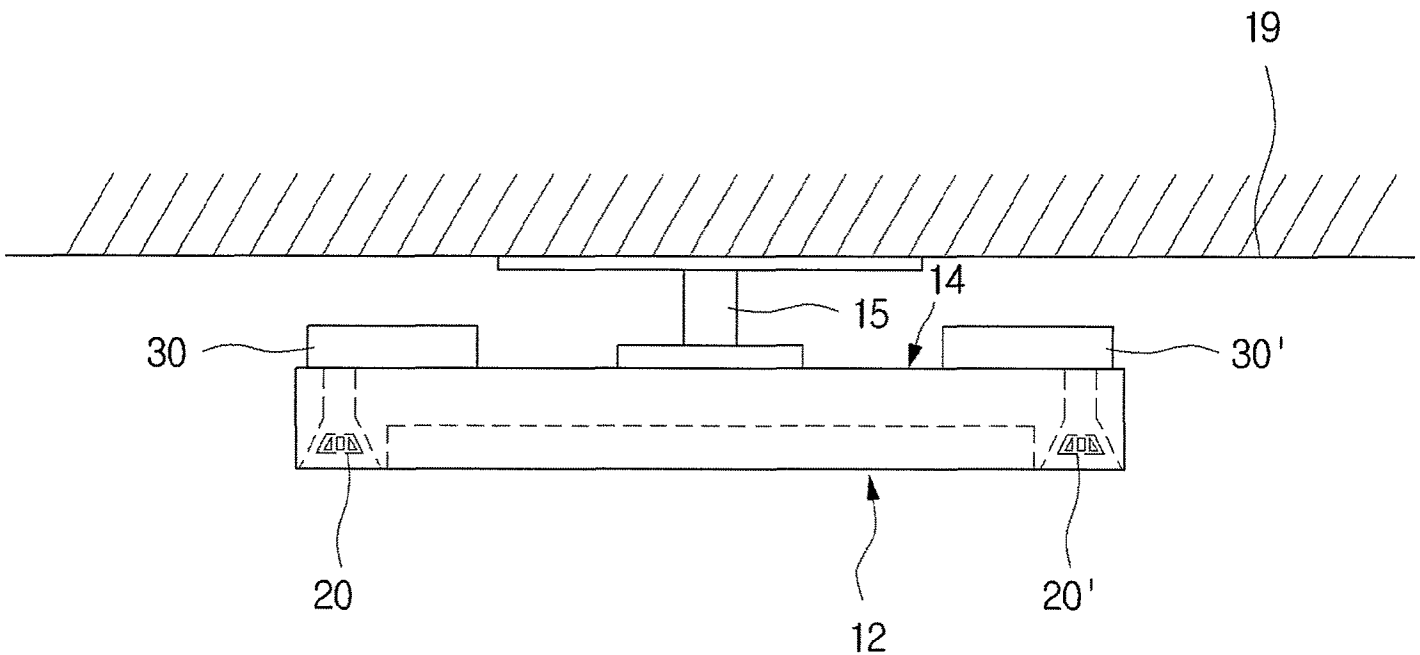
FIG. 3A shows the sound system of the wall-mounted flat panel display apparatus in FIG. 2A that is viewed from the above.

FIG. 2 is a perspective view showing briefly a sound system of a wall-mounted flat panel display apparatus having a box-shaped acoustic resonator in a first embodiment of the present invention. FIG. 3A shows the sound system of the wall-mounted flat panel display apparatus in FIG. 2A when viewed from an upper side, and FIG. 3B shows the box-shaped acoustic resonator used in the sound system in FIG. 2.

Figure 3B:
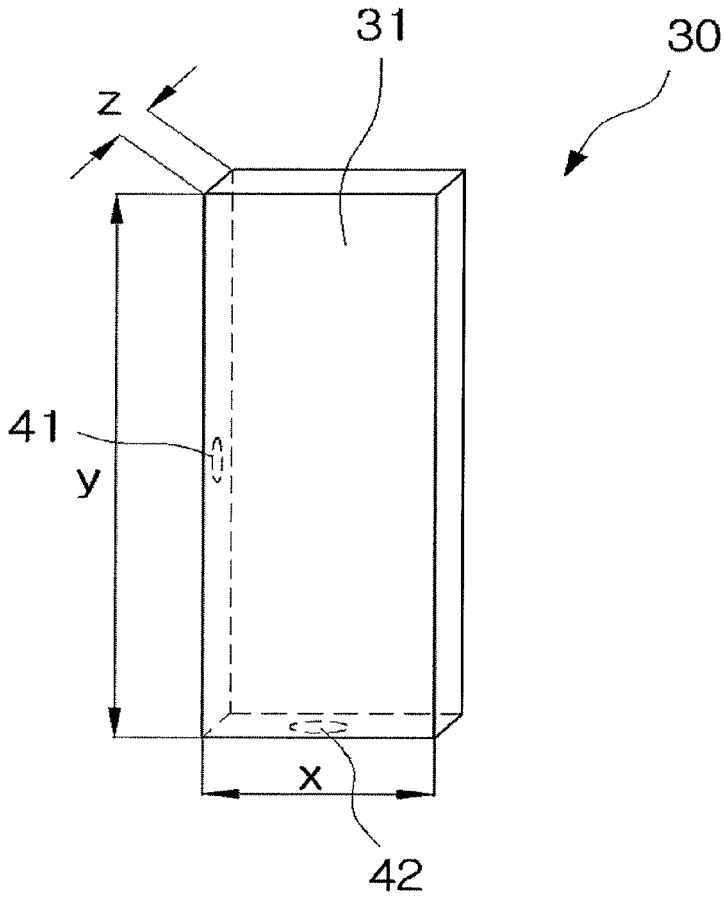
FIG. 3B shows the box-shaped acoustic resonator used in the sound system in FIG. 2.

As shown FIG. 2 through FIG. 3B, the acoustic resonator of the wall-mounted flat panel display apparatus in accordance with the first embodiment of the present invention can include speakers 20 and 20' mounted inside of the flat panel display apparatus 10 and playing back sounds and acoustic resonators 30 and 30' mounted in the back side 14 of the flat panel display apparatus 10.

In FIG. 2 through FIG. 3B, it is assumed that the flat panel display apparatus 10 includes a two-channel sound system in which a first speaker 20 and a second speaker 20' are mounted in a left side and a right side, respectively, of the flat panel display apparatus 10 when viewed from the front side 12. It is also assumed that each of the first speaker 20 and the second speaker 20' includes a high-frequency speaker sub-unit 20*a* or 20*a'* for playing back high-frequency sounds, a low-frequency speaker sub-unit 20*b* or 20*b'* for playing back low-frequency sounds, and a mid-frequency speaker sub-unit 20*c* or 20*c'* for playing back mid-frequency sounds.

Since the flat panel display apparatus 10 includes the two-channel sound system, it is illustrated that a total of two acoustic resonators 30 and 30' are mounted at particular areas, respectively, of the back side 14, corresponding to the areas on which the first speaker 20 and the second speaker 20' have been mounted. However, this is merely an example. There can be various modifications in the number and positions of mounted acoustic resonators. This can be also understood from the below description.

Hereinafter, shape, function, position, and number of the mounted acoustic resonators 30 and 30' will be described in more detail.

In accordance with the first embodiment of the present invention, the acoustic resonators 30 and 30' can have box-shapes. Although FIG. 2 through FIG. 3B shows that the acoustic resonators 30 and 30' have a box shape of rectangular parallelepiped, the acoustic resonators 30 and 30' can have a box shape of simple parallelepiped or multi-sided box shape, if the box has 6 or more or less surfaces, or spherical or cylindrical box shape.

Alternatively, it may not be necessary that any two opposite surfaces have the same size. It may be because the acoustic resonators 30 and 30' are not limited to a particular shape to perform the induction of sound resonance. This can be easily understood through the below description related to the function (e.g. the induction of sound resonance) to be performed by the acoustic resonators 30 and 30' according to the present invention.

However, two conditions may be required to be satisfied. Firstly, the horizontally directed length (refer to 'x' of FIG. 3B) or the vertically directed length (refer to 'y' of FIG. 3B) of the acoustic resonator 30 or 30' may be required to be longer than the distance spaced between the back side 14 and the adjacent wall surface 19 of the flat panel display apparatus 10 when viewed from the front side 12.

It may be because the acoustic resonators 30 and 30' in accordance with the first embodiment of the present invention aim to induce the resonance of the back sounds (especially, low-frequency back sounds) and adequately maintain or improve the sound balance. Therefore, it is necessary to acquire a space and a length that is enough to induce the resonance of the low or mid-frequency sounds through the inside of the acoustic resonators 30 and 30'.

Secondly, the width (or thickness) of the acoustic resonators 30 and 30' may be required to be smaller (or equal to, at the most) than the distance spaced between the back side 14 and the adjacent wall surface 19 of the flat panel display apparatus 10 when viewed from the front side 12.

This may be because the present invention also aims to efficiently use the remaining space without any modification in the appearance of the flat panel display apparatus 10 by arranging the acoustic resonators 30 and 30' in empty space between the back side 14 and the adjacent wall surface 19 of the flat panel display apparatus 10.

For the convenience of description, however, it is assumed that the acoustic resonators 30 and 30', as shown in FIG. 2 through FIG. 3B, has the rectangular parallelepiped shape, of which any two opposite surfaces have identical size and the vertically directed length is longer than the horizontally directed length.

The acoustic resonator 30 or 30' can include any one surface which is an open surface (refer to the reference numeral 31). This may be because the acoustic resonators 30 and 30' are mounted at the back side 14 of the flat panel display apparatus 10 in order to receive back sounds projected toward the back side 14 and induce the resonance of the received back sounds.

Accordingly, it may be necessary that any one surface of the acoustic resonator 30 or 30', which is to be in surface-contact with the back side 14 of the flat panel display apparatus 10, may be an open surface, instead of a closed surface, in order to adequately collect the back sounds. At this time, it may be unnecessary that the whole portion of the pertinent surface is opened. Only a part of the surface can be opened.

FIG. 3B shows an example of the acoustic resonator 30 with one surface fully opened (i.e. an open surface 31) of the acoustic resonator 30. However, even if only a part of the surface is opened, there should be no problem in collecting the back sounds. Hereinafter, it is assumed that one of the surfaces of the acoustic resonator 30 is fully opened (i.e. the open surface 31) as shown in FIG. 3B.

It may be necessary that the open surface 31 (or not shown) of the acoustic resonator 30 or 30' is in contact with the back side 14 of the flat panel display apparatus 10. The reason is that the back sounds inputted into the space of the acoustic resonator 30 or 30' may leak to the outside before resonating if the open surface 31 is not in contact with the back side 14.

For this, it may be required that the open surface 31 (or not shown) (or more particularly, each edge of the open surface 31) of the acoustic resonator 30 or 30' has windings corresponding to the contours of the back side 14 of the flat panel display apparatus 10. In this specification, all drawings of the flat panel display apparatus 10 have the flat back side 14. However, the back side 14 may be a curved surface.

Hereinafter, the principle of inducing the resonances of the high, mid, and low-frequency sounds by using the acoustic resonators 30 and 30' will be described. For the convenience of description, as shown in FIG. 3B, the acoustic resonator 30 or 30' is assumed to have a box shape of rectangular parallelepiped, in which the vertically directed length is approximately at least two times as long as the horizontally directed length.

Firstly, the resonance of the high-frequency back sounds can be induced in the widthwise direction (refer to 'z' of FIG. 3B) of the acoustic resonator 30. As described above, this may be because the width of the acoustic resonator 30 is made smaller than the distance spaced between the back side 14 and the adjacent wall surface 19 of the flat panel display apparatus 10, and the width of the acoustic resonator 30 is short enough to induce the resonance of the high-frequency sound.

However, although the resonance of the high-frequency back sounds is induced, the resonated high-frequency back sounds may not be able to leak much to the outside. This may be because the sound wave is a longitudinal wave, and the direction of the resonance of the high-frequency back sounds is perpendicular to the holes 41 and 42 that are formed at the left and the right side, respectively.

Next, the resonance of the low-frequency back sounds can be induced in the vertical direction (refer to 'y' of FIG. 3B) inside the acoustic resonator 30. This may be because the vertical length of the acoustic resonator 30 is long enough to induce the resonance of the low-frequency back sounds.

The resonating low-frequency back sounds can leak to the outside through the hole 42 formed on a lower surface of the acoustic resonator 30. This may be because the resonance direction of the low-frequency sounds is parallel with the hole 42. Similarly, the resonance of the mid-frequency back sounds can be induced in the horizontal direction (refer to 'x' of FIG. 3B) of the acoustic resonator 30. The resonating mid-frequency back sounds can leak to the outside through the hole 41 formed on a left surface of the acoustic resonator 30.

As described above, in accordance with the first embodiment of the present invention, the acoustic resonator 30 or 30' can allow low-frequency sounds to be projected toward the outside (i.e. the front side 12).

Accordingly, in accordance with the first embodiment of the present invention, it can be possible to solve the problems of over-amplification of high-frequency sounds and the distortion, caused by the resonance of high-frequency sounds, and rapid decrease of mid and low-frequency sounds, caused by the destructive interference of the mid and low-frequency sounds, in a sound system of the conventional wall-mounted flat panel display apparatus, adequately maintaining the balance among the outputted sounds.

FIG. 2 and FIG. 3B show that the holes 41 and 42 for outputting the resonating mid or low-frequency sounds are formed on either of a left side and a right side and either of an upper side and a lower side, respectively, of the acoustic resonator 30 and the similar is applied for holes 43 and 44 for outputting the resonating mid or low frequency sounds in the acoustic resonator 30'. This is merely an embodiment of the present invention. Alternatively, holes can be formed on all surfaces including left, right, upper, and lower sides of the acoustic resonators 30 and 30' or only one hole can be formed on only one of these sides of the acoustic resonators 30 and 30'.

Here, the reason that the holes 41 and 42 are formed on the left and the lower surface, respectively, of the acoustic resonator 30 and the holes 43 and 44 on the right and the lower surface, respectively, of the acoustic resonator 30' as shown in FIG. 2 is to give the directivity to the sounds outputted through the holes.

Moreover, it may be unnecessary to have any one hole on the acoustic resonator 30 or 30'. With no hole formed on the acoustic resonator 30 or 30', it can still be possible to prevent the over-amplification and the distortion caused by the resonance of the high-frequency sounds among the problems of the related art. This can maintain audio balance to a certain degree.

Hitherto, the shapes and functions of the acoustic resonator have been described in detail. Hereinafter, the position and the number of the mounted acoustic resonators will be briefly described. This is because the position and the number of the mounted acoustic resonators can be selected by a user in consideration of the efficiency of improving the sound systems.

For example, in accordance with the first embodiment of the present invention, the acoustic resonator can be mounted in an area in which the back sounds projected from the speaker toward the back side of the flat panel display apparatus is most efficiently collected. In particular, when the hole for outputting sounds is formed at the back side of the flat panel display apparatus, the acoustic resonator can be mounted to wholly (or partially) cover such a hole.

Alternatively, when it is difficult to place the acoustic resonator in close contact with the back side of flat panel display apparatus because of protrusions or windings, the acoustic resonator can be mounted in a next best area.

When the number of the mounted acoustic resonator is to be determined, the similar principle can be applied. If using one acoustic resonator will be good enough to improve sound the quality to a desired degree, no more acoustic resonators may be required in consideration of the cost.

Figure 4:
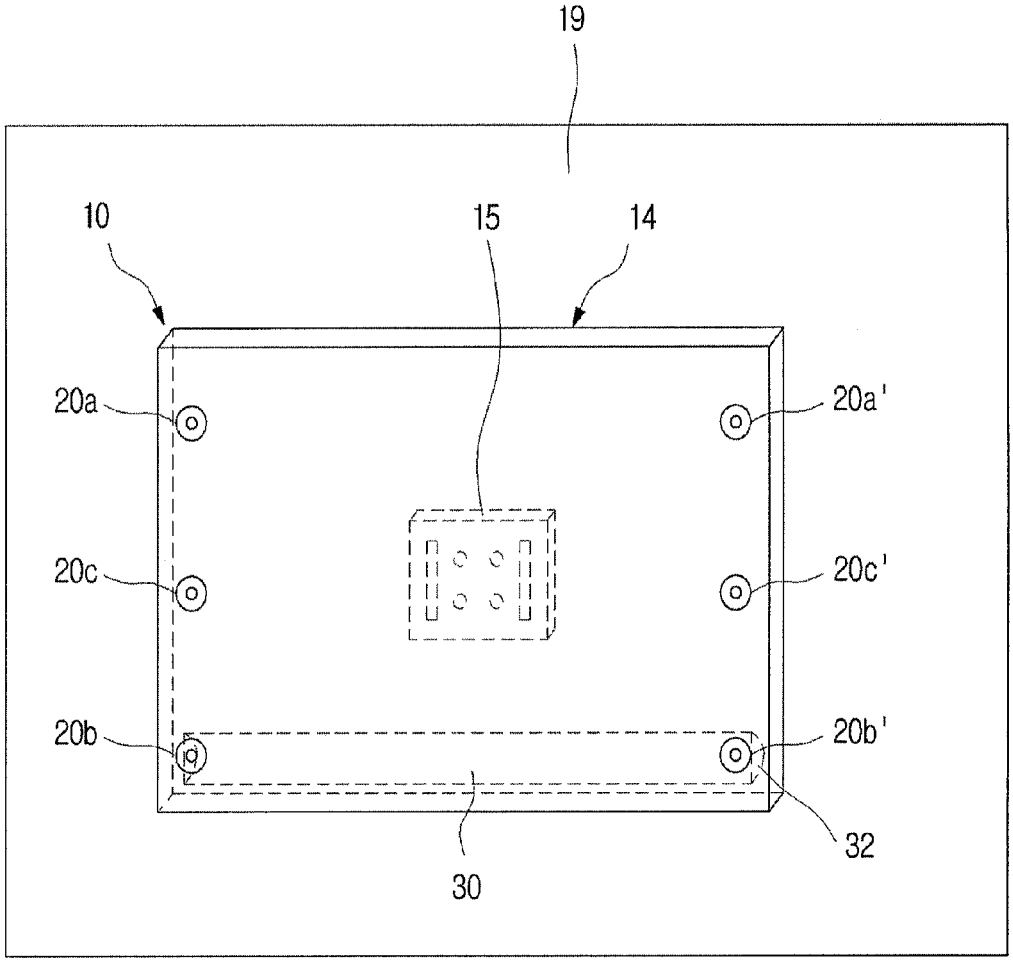
FIG. 4 is a perspective view showing briefly a sound system of a wall-mounted flat panel display apparatus having a pipe-shaped acoustic resonator in a second embodiment of the present invention.
Figure 5:
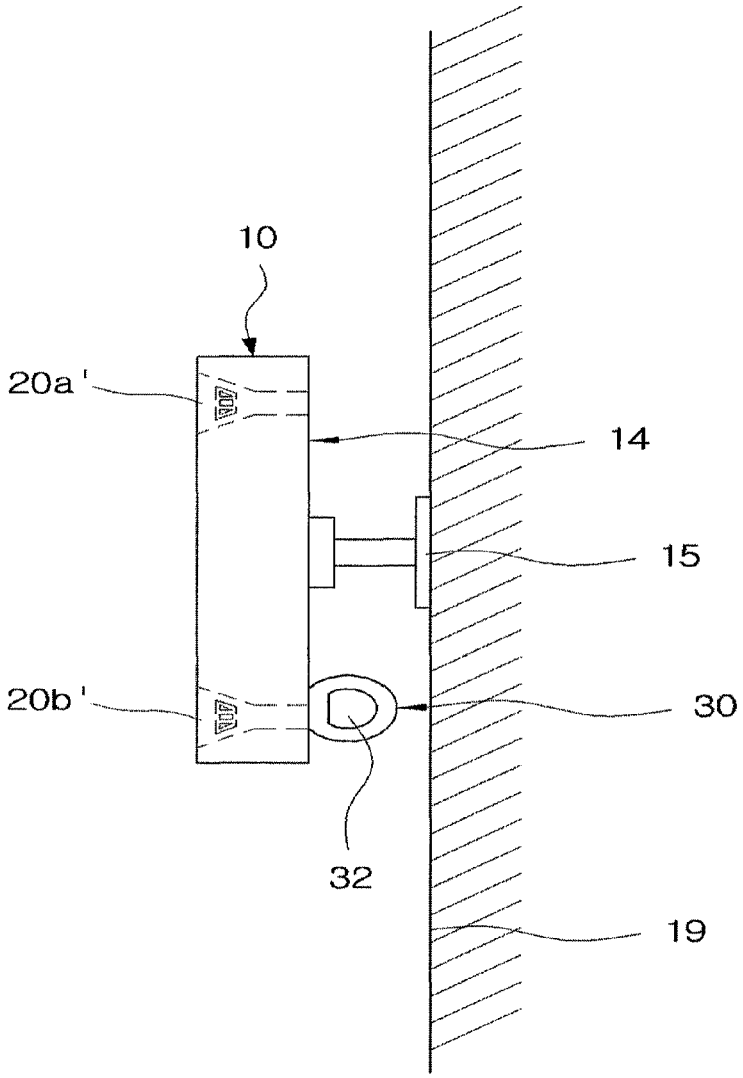
FIG. 5 is a side view showing the sound system of the wall-mounted flat panel display apparatus in FIG. 4.

FIG. 4 is a perspective view showing briefly a sound system of a wall-mounted flat panel display apparatus having a pipe-shaped acoustic resonator in a second embodiment of the present invention, and FIG. 5 is a side view showing the sound system of the wall-mounted flat panel display apparatus in FIG. 4.

As shown in FIG. 4 and FIG. 5, a sound system of a wall-mounted flat panel display apparatus in accordance with the second embodiment of the present invention can include speakers 20 and 20' mounted inside of the flat panel display apparatus 10 and playing back sounds and acoustic resonators 30 and 30' mounted in the back side 14 of the flat panel display apparatus 10. Any matter already described in FIG. 2 through FIG. 3B will be not redundantly described, and the second embodiment of the present invention will be described based on the difference in the shape of the acoustic resonator and the sound quality improvement.

In accordance with the second embodiment of the present invention, the acoustic resonator 30 can have a pipe shape. For example, FIG. 4 and FIG. 5 show that the acoustic resonator 30 has one flat surface, which is to be easily attached to the back side 14 of the flat panel display apparatus 10, and a circular surface at the other side with its diameter regularly maintained along the pipe. Alternatively, there can be various modifications as described in the above embodiment of the present invention.

For example, the pipe-shaped acoustic resonator 30 can have a circular, elliptic, or multi-polygonal cross-section. Even if the cross-sectional shape and size are maintained uniformly along the pipe in a normal embodiment, the diameter of the cross-section can be varied along the pipe.

In the second embodiment of the present invention, there are also two restrictions similar to the first embodiment of the present invention. Firstly, the length between one end part and the other end part of the acoustic resonator 30 may be required to be longer than the distance spaced between the back side 14 and the adjacent wall surface 19 of the flat panel display apparatus 10.

Secondly, the width (or the diameter of the cross-section) of the acoustic resonator 30 may be required to be smaller than (or, at the most, equal to) the distance spaced between the back side 14 and the adjacent wall surface 19 of the flat panel display apparatus 10 when viewed from the front side 12. The reason is the same as described above.

The acoustic resonator 30 can have one end part that is open (refer to the reference numeral 32 of FIG. 4 and FIG. 5 and hereinafter, referred to as an "open end part") and the other end part that is closed. This may be because it is required to allow one end part of the acoustic resonator 30 to be closed so as to reflect back sounds inputted into the inside of the acoustic resonator 30 and the other end part to be opened so as to make the back sounds come in and out of the resonator and therefore the acoustic resonator 30 receive the back sounds and induce the resonance of the back sounds in accordance with the second embodiment of the present invention. Here, the back sounds are projected from the speakers 20 and 20' in the direction of the back side 14.

In other words, in accordance with the second embodiment of the present invention, the open end part 32 of the acoustic resonator 30 can simultaneously function as an entrance for receiving the back sounds before resonating and an exit for outputting the back sounds after resonating.

In accordance with the second embodiment of the present invention, the acoustic resonator 30 features about two differences as compared with the first embodiment of the present invention. Firstly, in accordance with the first embodiment of the present invention, since the acoustic resonator 30 has the box-shape, a total of two lengthwise dimensions (i.e. in the horizontal and vertical directions) can be differently controlled to simultaneously induce the resonance of the mid-frequency sounds and the resonance of the low-frequency sounds. In accordance with the second embodiment of the present invention, however, since the acoustic resonator 30 has a pipe-shape, only one lengthwise dimension can be controlled to induce a resonance in one of the audio sound spectra according to the length of the acoustic resonator 30.

Accordingly, it may be required to mount a multiple of the acoustic resonator 30 having different lengths in order to induce the resonance both in the mid-frequency and low-frequency sounds FIG. 4 and FIG. 5 show a case of mounting the acoustic resonator 30 in a lower surface of the back side 14, where the low-frequency speaker sub-unit 20*b'* for plying back the low-frequency sound is nearby.

Similar to the first embodiment of the present invention, the position and the number of the mounted acoustic resonators 30 can be also selected by a user in consideration of the sound improving efficiency in the second embodiment of the present invention. In consideration of sound collecting properties according to the second embodiment of the present invention, however, it may be necessary to mount the acoustic resonator 30 such that the open end part 32 is most adjacent to a mounted speaker in order easily to collect the back sounds.

Similarly to the above description, in case that a hole for outputting sounds is formed in the back side 14 of the flat panel display apparatus 10, the acoustic resonator 30 can be mounted such that the open end part 32 is most adjacent to the hole.

The same description as the first embodiment can be applied when the number of the mounted acoustic resonators 30 is determined. If mounting one acoustic resonator 30 is not enough to improve the sound quality to a desired degree, it can be possible to mount more than one acoustic resonator 30.

Hitherto, the case of inducing the resonance of the "back sounds" of sounds projected from the speaker by "mounting" an acoustic resonator that is "separately formed" to have a box or pipe shape in a "back side" of a flat panel display apparatus has been described in accordance with the first and second embodiments of the present invention. However, there can be various other embodiments of the present invention.

This will be described with reference to FIG. 6 though FIG. 8. Any matter (e.g. shape, resonating principle, and number of mounted acoustic resonators) already described in the above embodiments will be not redundantly described, and the following embodiments will be described based on the differences from the above embodiments of the present invention.

Figure 6:
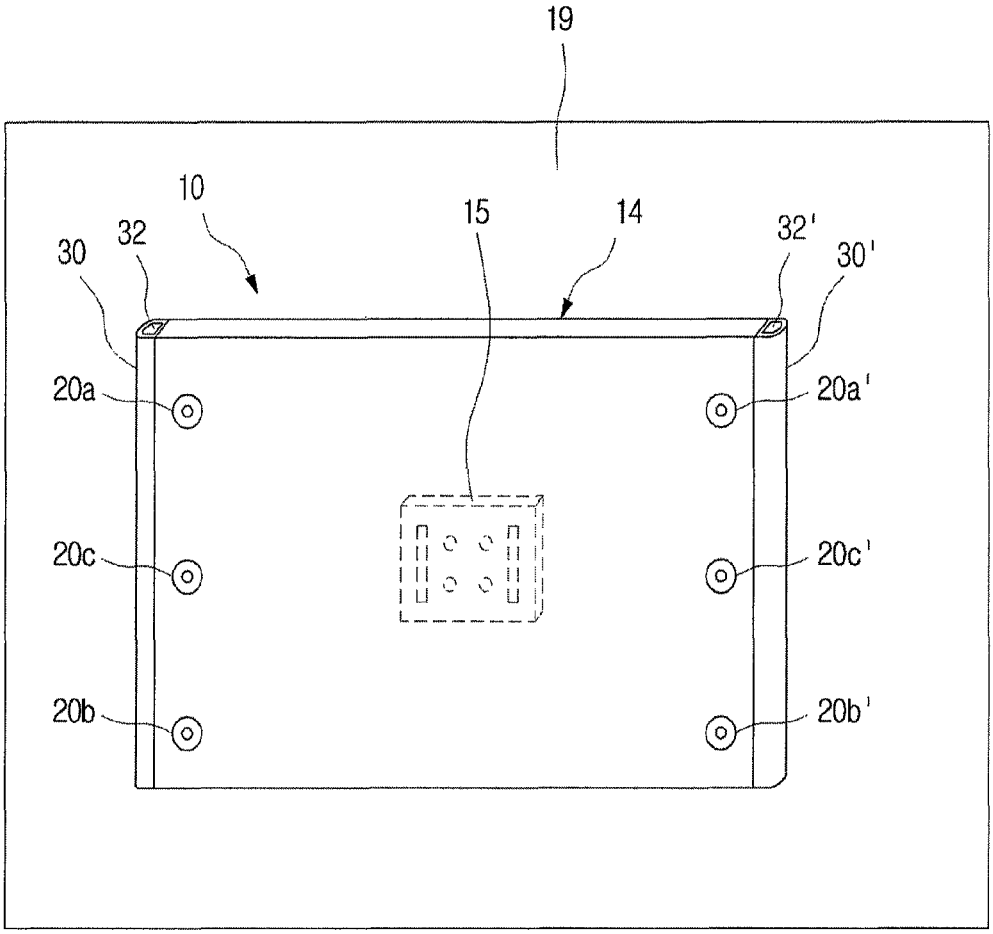
FIG. 6 is a perspective view showing briefly a sound system of a wall-mounted flat panel display apparatus having a pipe-shaped acoustic resonator in a third embodiment of the present invention.
Figure 7:
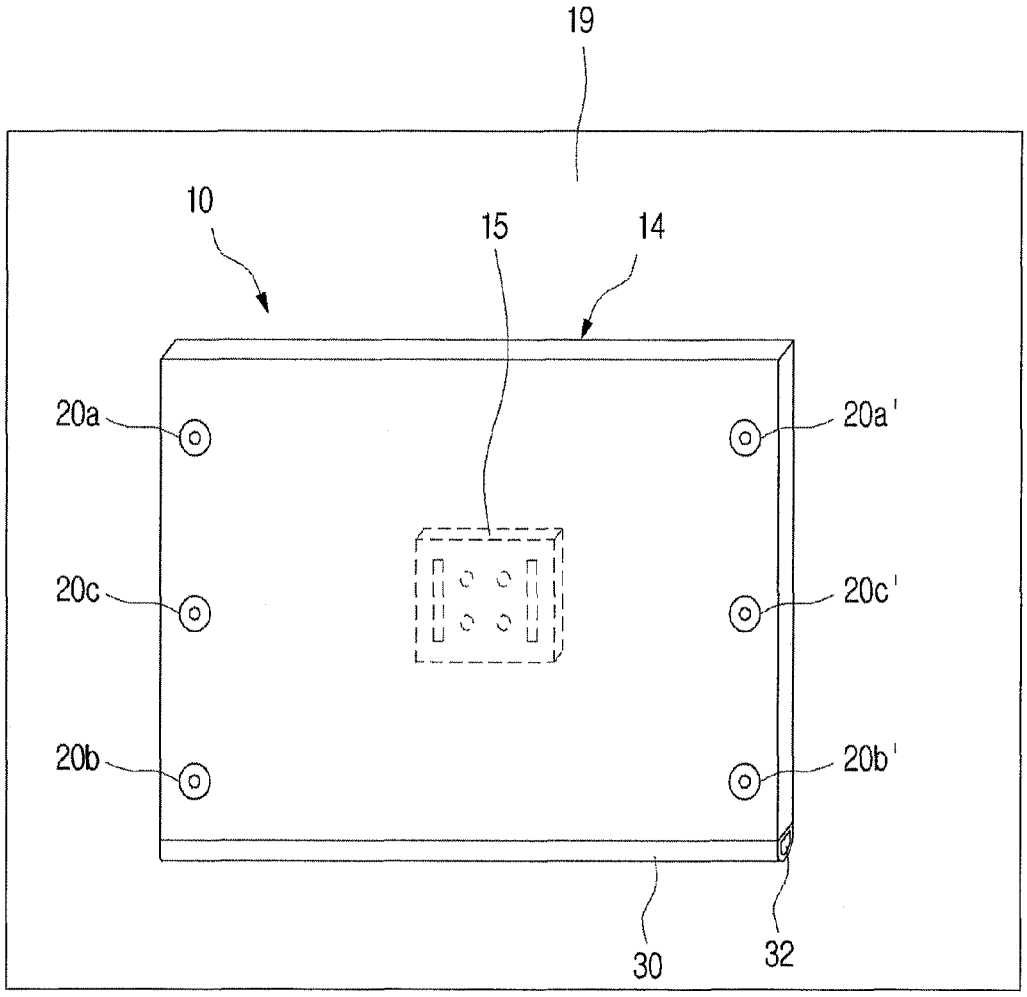
FIG. 7 is a perspective view showing briefly a sound system of a wall-mounted flat panel display apparatus having a pipe-shaped acoustic resonator in a fourth embodiment of the present invention.

FIG. 6 is a perspective view showing briefly a sound system of a wall-mounted flat panel display apparatus having a pipe-shaped acoustic resonator in a third embodiment of the present invention, and FIG. 7 is a perspective view showing briefly a sound system of a wall-mounted flat panel display apparatus having a pipe-shaped acoustic resonator in a fourth embodiment of the present invention. FIG. 8 is a side view showing briefly a sound system of a wall-mounted flat panel display apparatus having a pipe-shaped acoustic resonator in a fifth embodiment of the present invention.

Firstly, as shown in FIG. 6, the pipe-shaped acoustic resonators 30 and 30' can be mounted in the left and the right side, respectively, of the flat panel display apparatus 10, instead of mounting in the back side 14. As shown in FIG. 7, the pipe-shaped acoustic resonator 30 can be also mounted in the lower side of the flat panel display apparatus 10.

As such, mounting the pipe-shaped acoustic resonator 30 or 30' in at least one of the left, right, lower, and upper sides of the flat panel display apparatus 10 can make it possible to receive the ambient sounds projected from a speaker or speakers through the open end parts 32 and 32' and to induce the resonance of the sounds.

Unlikely in the above embodiments of the present invention, however, when the acoustic resonator is mounted in any side of the flat panel display apparatus except for the back side, there may be no restriction in the widthwise directed length of the acoustic resonator. This may be because it is unnecessary to put a limitation on the width according to the distance spaced between the back side and the adjacent wall surface of the flat panel display apparatus. Accordingly, the same principle as described in the two above embodiments can be applied to the remaining parts.

Figure 8:
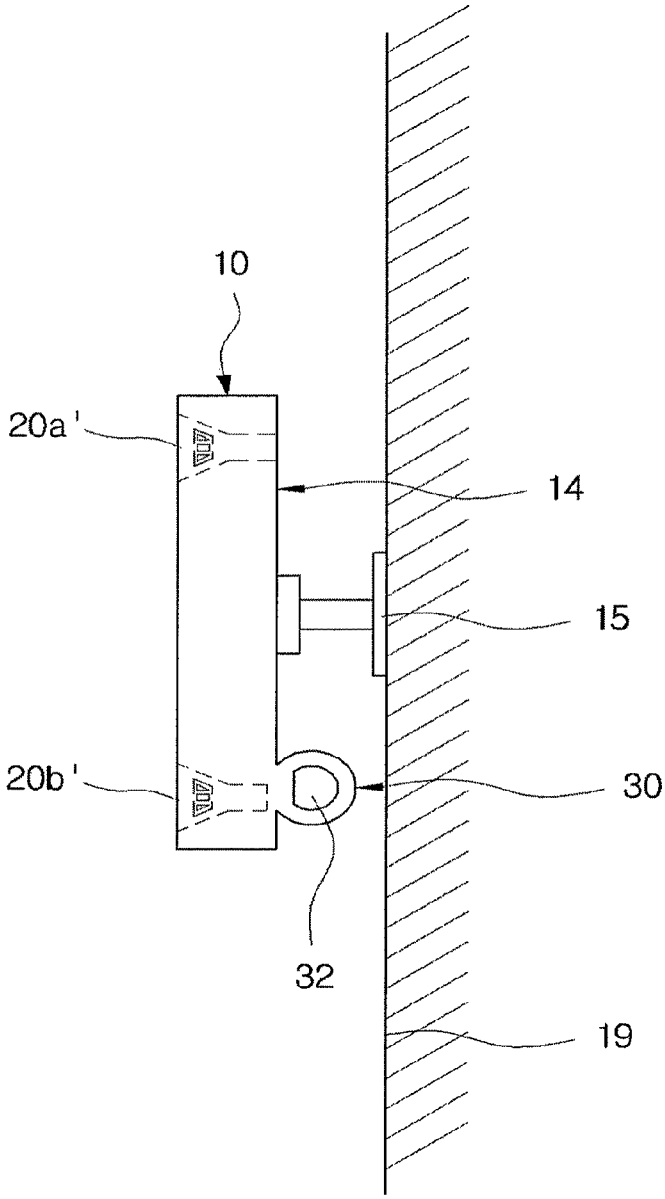
FIG. 8 is a side view showing briefly a sound system a wall-mounted flat panel display apparatus having a pipe-shaped acoustic resonator in a fifth embodiment of the present invention.

As shown in FIG. 8, the pipe-shaped acoustic resonator 30 can be manufactured as one body in the case of the flat panel display apparatus 10. In particular, in the case of FIG. 2 through FIG. 7, the pipe or box-shaped acoustic resonator can be separately manufactured, and then mounted in an outer side of a case of the flat panel display apparatus 10. In the case of FIG. 8, however, it can be possible to manufacture the case of the flat panel display apparatus having a particular-shaped acoustic resonator made of the same material and permanently included as one body thereto.

FIG. 8 shows the acoustic resonator that is manufactured as one body with the rest of the case at the back side of the flat panel display apparatus. However, it shall be obvious that the acoustic resonator can be manufactured as one body in the left, right, upper, and/or lower sides, of the flat panel display apparatus.

Figure 9A:
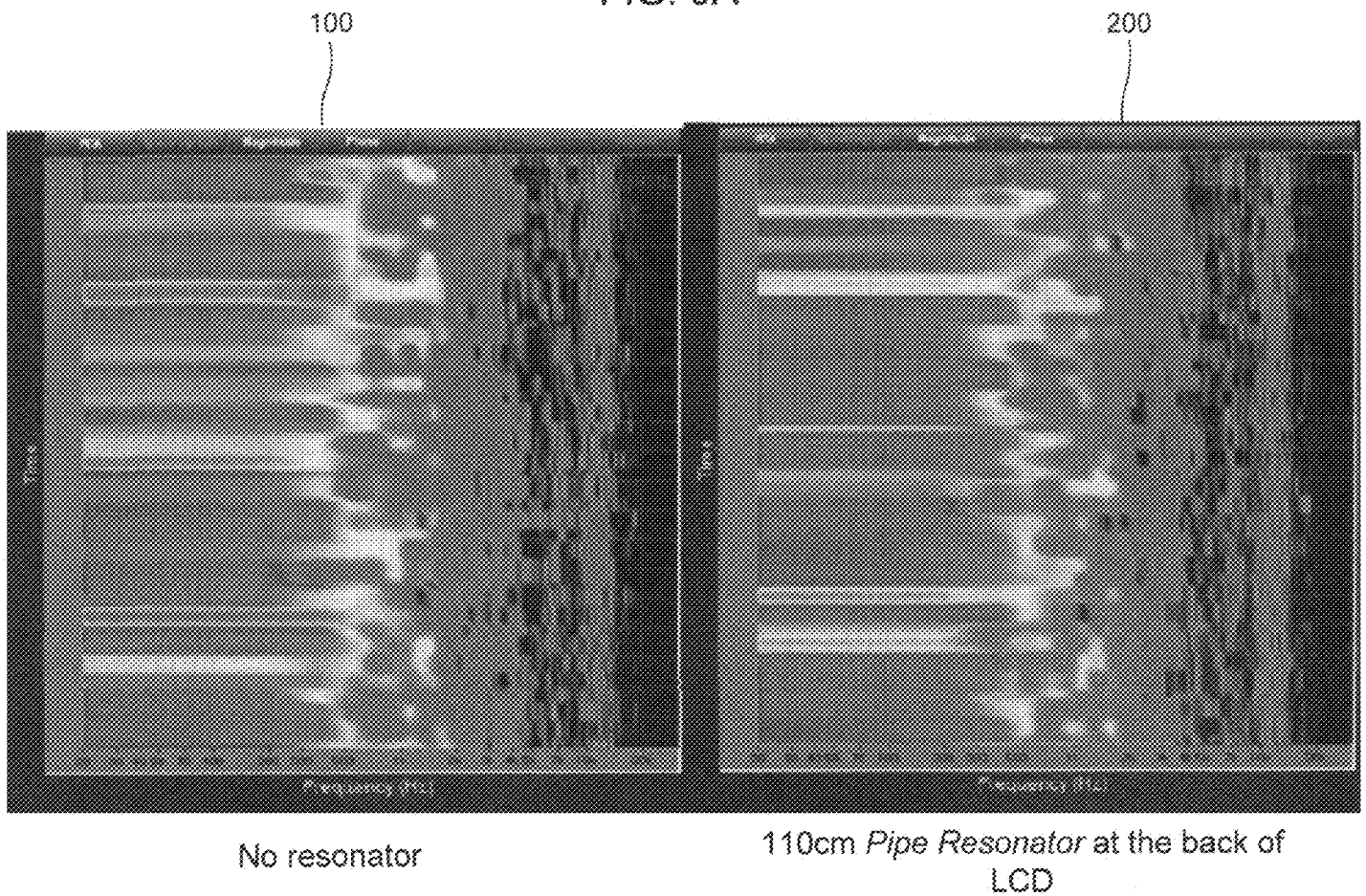
FIG. 9A shows each spectrograph of an audio frequency band according to the related art and an actual experiment to verify sound quality improved by a sound system in accordance with embodiments of the present invention.
Figure 9B:
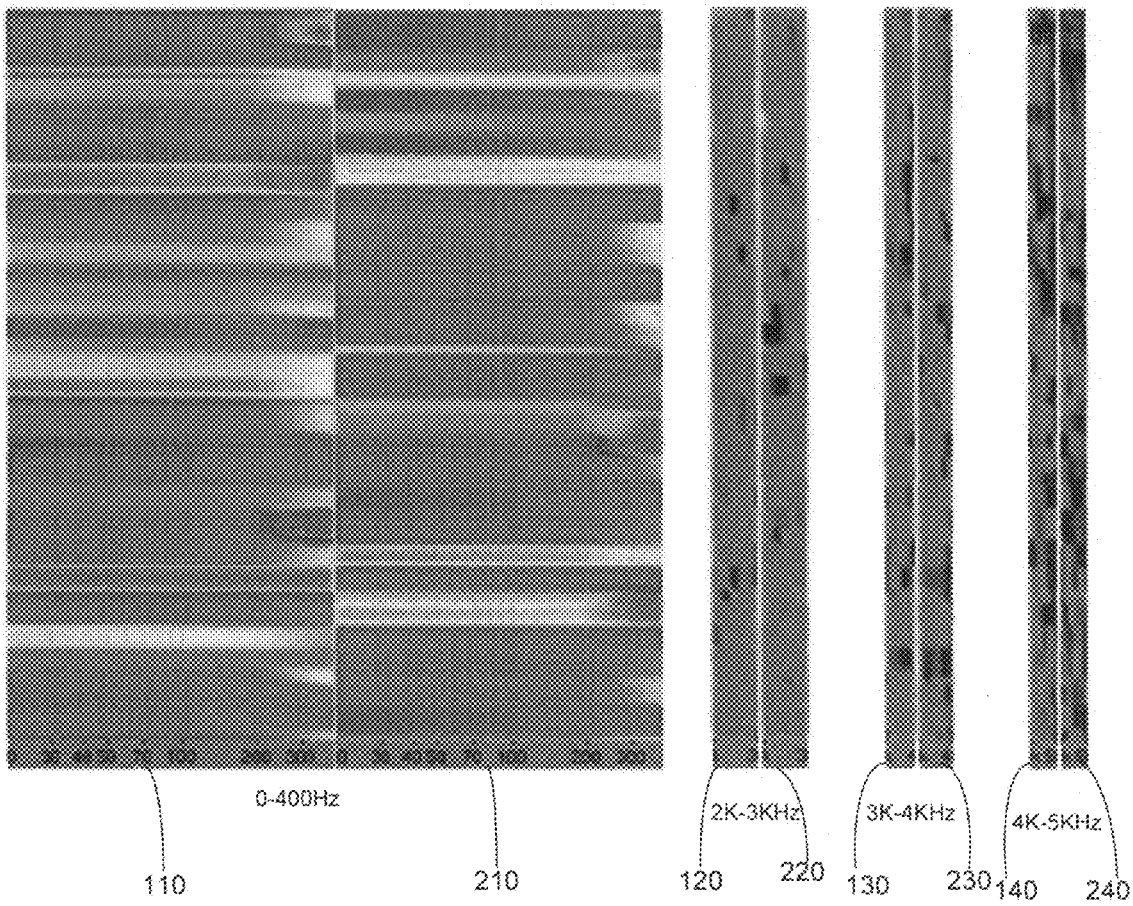
FIG. 9B shows the spectrographs of FIG. 9A per frequency band.

FIG. 9A shows spectrographs of an audio sound produced in the related art and an actual experiment to verify sound quality improved by a sound system in accordance with an embodiment of the present invention, and FIG. 9B shows the spectrographs per frequency band.

The experimental conditions will be firstly described in brief before the detailed description related to FIG. 9A and FIG. 9B. In the experiment, a 42 inch LCD TV is used for the wall-mounted flat panel display apparatus, and a PVC water pipe having the length of 110 cm and the diameter of 4 cm is used for the acoustic resonator mounted in the back side of the flat panel display apparatus. In this case, a left side end part of the pipe is closed, and a right side end part is open, and then the pipe is fixed in a lower part of the wall-mounted TV.

An audio sound of pink noise is inputted into the TV and is amplified and then outputted into the room by the sound system of the wall-mounted TV. The sound is caught by a microphone and recorded in a computer. The frequency analysis is performed on the recorded sound signal in real time by using the fast Fourier transform (FFT).

In general, the spectral magnitude of the pink noise obtained by the FFT is fluctuating in time. In this case, it is very hard to observe any change in the spectrum only by seeing the spectrum at a fixed time. In this experiment, therefore, the spectrum is observed by using a spectrograph as shown in FIG. 9A where the horizontal axis represents audio frequency from 20 Hz to 20 KHz and the vertical axis time in second. The spectral strengths are represented by different colors. When the magnitude of a frequency component is gradually increased from zero, the representative color will change successively in the order of black, dark blue, light blue, green, yellow, and red. In brief, when a horizontal line is drawn at the spectrograph 100 or 200, the colors observed on the line represent the magnitude of the corresponding audio frequency at the pertinent time.

In particular, the left of FIG. 9A is a photograph of the spectrograph 100 when no acoustic resonator is mounted in the wall-mounted TV in accordance with the related art, and a right is that of the spectrograph 200 when a pipe-shaped acoustic resonator is mounted at the lower back side of the wall-mounted TV in accordance with the experimental condition of the present invention.

FIG. 9B shows the spectrographs of FIG. 9A per frequency band. In particular, a first part of FIG. 9B, or the spectrographs 110 and 210, are for the low-frequency band from 0 to 400 Hz. The left spectrograph 110 is recorded with no acoustic resonator is mounted in the flat panel display apparatus, and the right spectrograph 210 recorded with a pipe-shaped the acoustic resonator mounted in the flat panel display apparatus.

Similarly, the pairs of spectrographs in the second, third, and fourth parts of FIG. B, which correspond to the spectrographs 120 and 220, 130 and 230, and 140 and 240, respectively, are for the frequency bands from 2 KHz to 3 KHz, from 3 KHz to 4 KHz, and from 4 KHz to 5 KHz, respectively. Similarly as above, the former spectrograph in the pair represents the sound spectrum recorded without the acoustic resonator and the latter in the pair that with the acoustic resonator mounted in the panel display apparatus.

In the first pair of the spectrographs 110 and 210 in FIG. 9B, the darker shade represents stronger strength of the spectrum. It can be clearly seen from the pair that the former spectrograph 110 has more change of shade in time (or vertically) compared with the latter spectrograph 210. Since these spectrographs represent the spectral distributions of an input pink noise, the temporal variation of the strength of a frequency component should be minimal in an ideal case. The temporal variation is directly related to the output sound quality of the flat panel display apparatus such that the low-frequency sound of the spectrograph 110 is uneven or unstable while that of the spectrograph 210 is more stable and solid compared with the former.

This may indicate that the quality of the low-frequency sound is better in the present invention than in the related art.

The length of the pipe-shaped acoustic resonator used in this experiment is 110 cm, which corresponds to the fundamental resonance frequency of 77 Hz, the second harmonic resonance frequency of 232 Hz, the third harmonic resonance frequency of 386 Hz, and so on. It can be seen from the spectrographs 110 and 210 that the acoustic resonator works efficiently for the fundamental and the second harmonic resonance frequencies. However, at the third harmonic resonance frequency of 386 Hz, there appears a lot of temporal fluctuations in both spectrographs 110 and 210, which means that the pipe-shaped acoustic resonator used in this experiment has little or no effect at this frequency or higher frequencies. This is why there is no apparent difference between the former and the latter spectrographs in the second, third, and fourth pairs in FIG. 9B.

With reference to FIG. 2 through FIG. 8, the sound system having a box or pipe-shaped acoustic resonator in the wall-mounted flat panel display apparatus has been described below. Hereinafter, a sound system having a bracket cover in the wall-mounted flat panel display apparatus will be described with reference to FIG. 10 through FIG. 14 in accordance with a yet another embodiment of the present invention.

As described above, high-frequency sounds outputted from a sound system of the wall-mounted flat panel display apparatus 10 may have their magnitude that is over-amplified by the resonance created through a narrow space between the back side 14 and the adjacent wall surface 19. At this time, a mounting bracket 15, which is a fixing means for fixing the flat panel display apparatus on the adjacent wall surface 19, is typically made of a metal. Accordingly, the high-frequency sounds may be reflected by the metal mounting bracket 15, thereby being distorted.

Thus, it may be required to prevent the distortion of the high-frequency sounds in order to maintain the general sound balance. The distortion of the high-frequency sounds can be prevented by using the bracket cover in accordance with a yet another embodiment of the present invention, which will be clearly understood through the below description.

In this specification, the terms of the mounting bracket is merely used for collectively referring to all types of fixing means for fixing a wall-mounted flat panel display apparatus on the wall. It shall be obvious that the mounting bracket is not limited to the shape, material, and structure of typical brackets.

Figure 10:
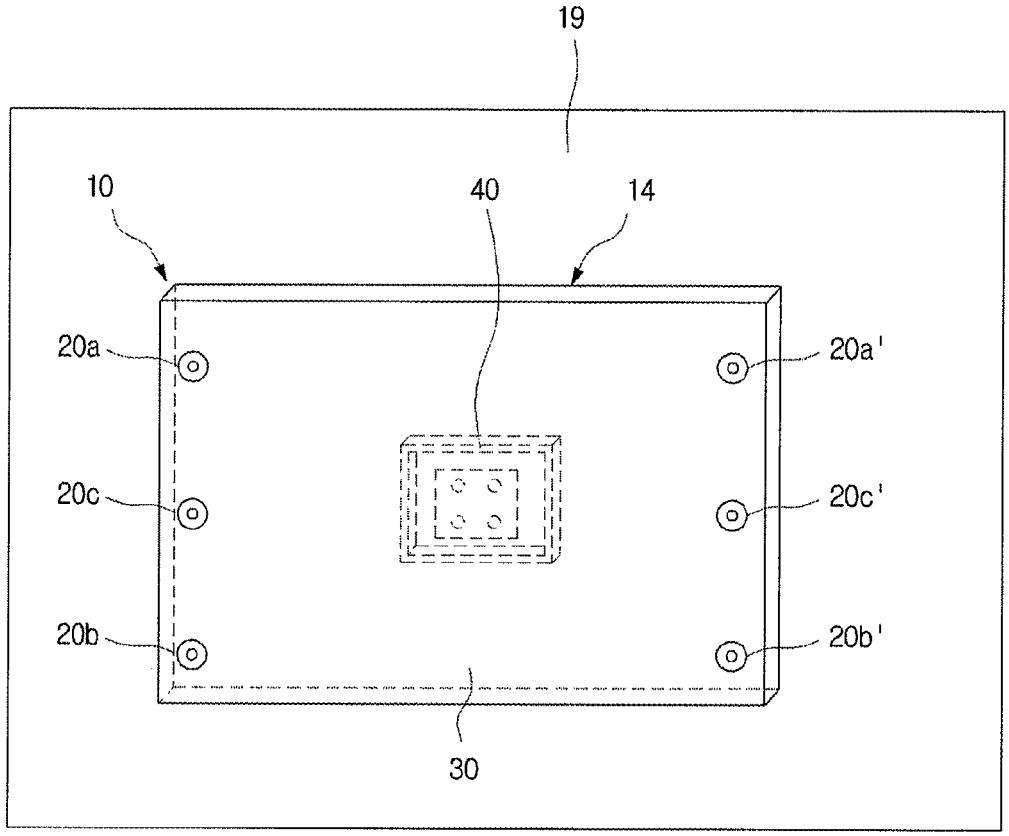
FIG. 10 is a perspective view showing briefly a sound system of a wall-mounted flat panel display apparatus having a bracket cover in accordance with a sixth embodiment of the present invention.
Figure 11:
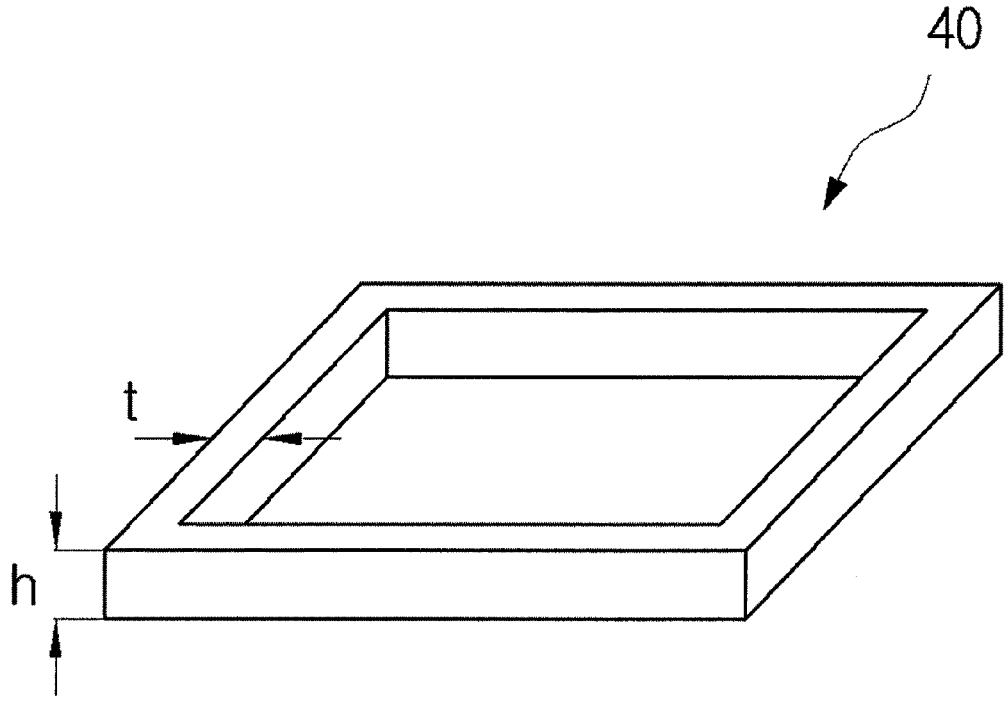
FIG. 11 shows the bracket cover of FIG. 10.

FIG. 10 is a perspective view showing briefly a sound system of a wall-mounted flat panel display apparatus having a bracket cover in accordance with a sixth embodiment of the present invention, and FIG. 11 shows the bracket cover of FIG. 10.

In accordance with the sixth embodiment of the present invention, the sound system of the wall-mounted flat panel display apparatus can include the speakers 20 and 20' mounted in the flat panel display apparatus 10 and playing back sounds and a bracket cover 40 preventing a sound projected from the speakers 20 and 20' from being reflected by a mounting bracket 15 by surrounding the mounting bracket 15 that mounts the flat panel display 10 on the adjacent wall surface.

It may be necessary that the material, height, and setting location of the bracket cover 40 be adequate for preventing the distortion of a sound, especially a high-frequency sound, caused as the high-frequency sound is reflected by the metal mounting bracket 15.

Accordingly, it can be considered as one of good examples that the bracket cover 40 is made of a nonmetallic material such as plastic or rubber. As one of good examples, the bracket cover 40 can be also manufactured such that its height (refer to "h" of FIG. 11 or FIG. 13) is equal to the distance between the back side 14 and the adjacent wall surface 19 and the space between the back side 14 and the adjacent wall surface 19 is made airtight in order to block all possible routes/paths that can transfer the high-frequency sound to the mounting bracket 15.

With the similar reason, the bracket cover 40 can be manufactured and equipped to surround the mounting bracket 15 as shown in FIG. 10 and FIG. 11, but this is unnecessary as described with reference to FIG. 12 and FIG. 13.

However, it may be unnecessary to have any limitation for the widthwise thickness (refer to "t" of FIG. 11 and FIG. 13) and the shape of the bracket cover 40. Even though FIG. 10, FIG. 11, and FIG. 14 shows the bracket cover 40 having a rectangular shape and FIG. 12 and FIG. 13 shows a bracket cover 40*a* having a rectangular shape with one side open, the bracket cover 40 can obviously have any other shapes. It may be also unnecessary that the bracket cover 40 follows the shape of the mounting bracket 15.

Figure 12:
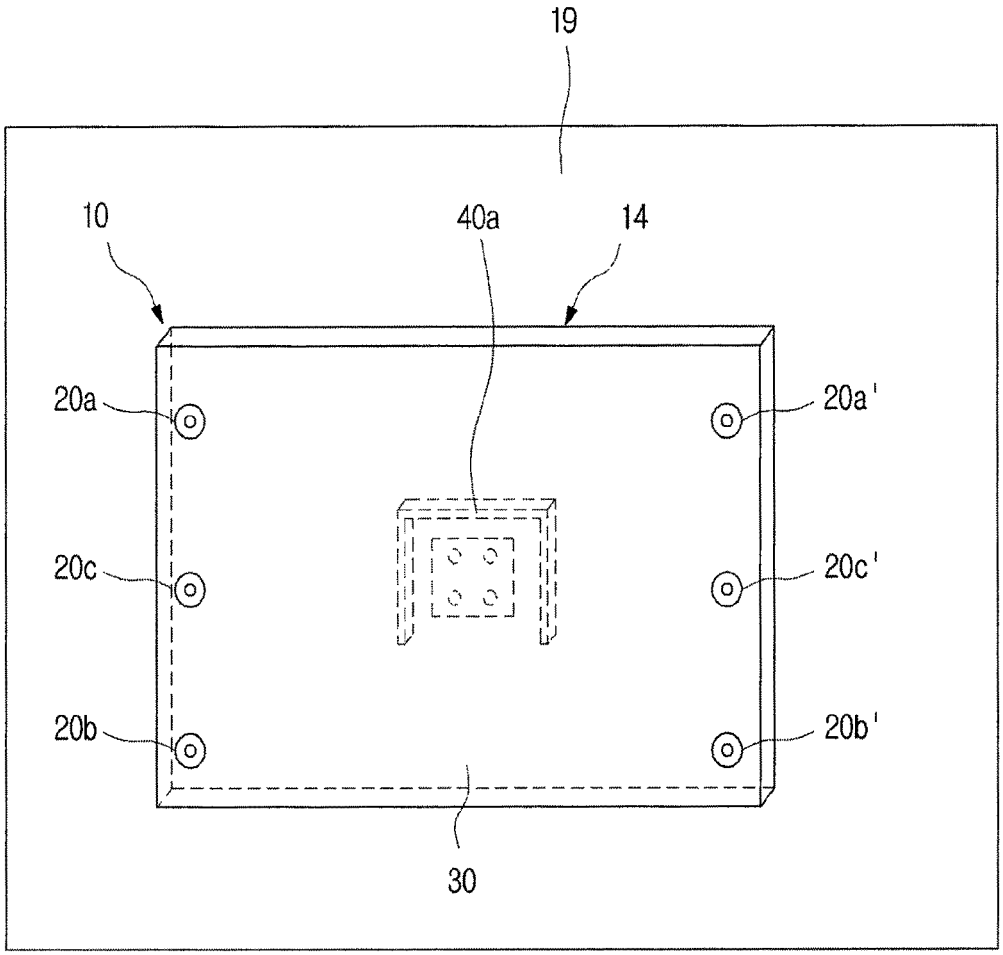
FIG. 12 is a perspective view showing briefly a sound system of a wall-mounted flat panel display apparatus having a bracket cover in accordance with a seventh embodiment of the present invention.
Figure 13:
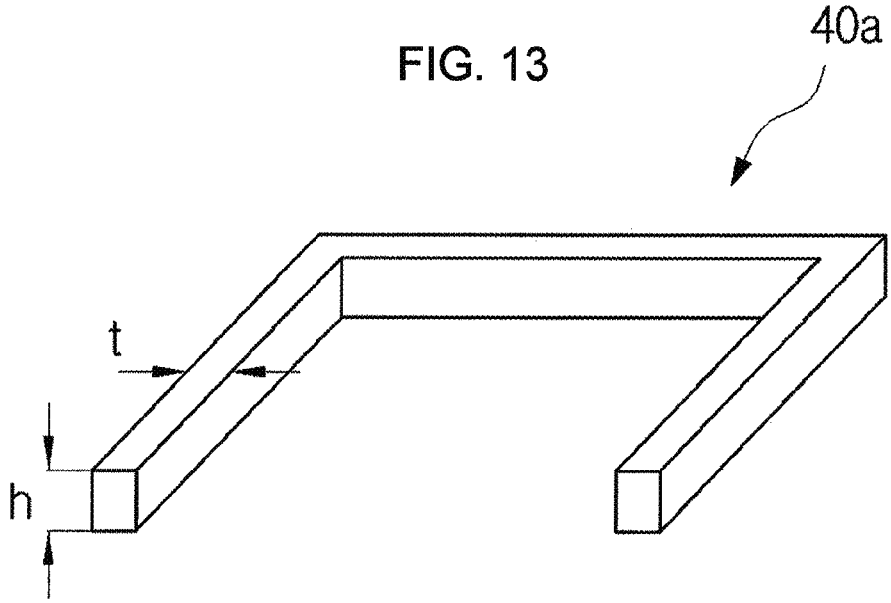
FIG. 13 shows the bracket cover of FIG. 12.
Figure 14:
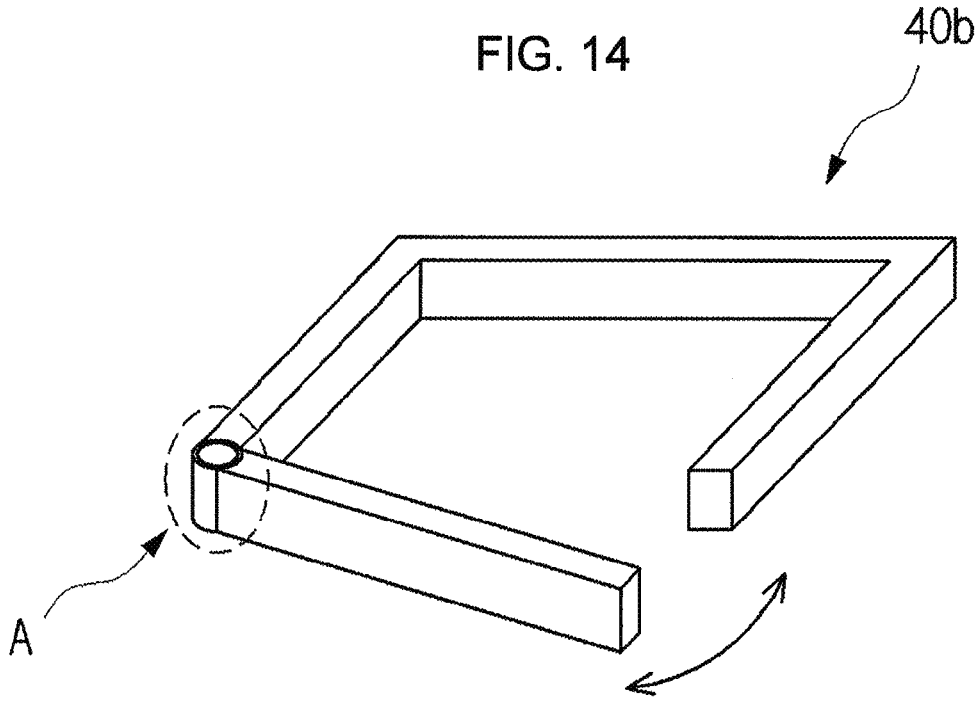
FIG. 14 shows a gated bracket cover which is applicable to a sound system of a wall-mounted flat panel display apparatus in accordance with the present invention.

FIG. 12 is a perspective view showing briefly a sound system of a wall-mounted flat panel display apparatus having a bracket cover in accordance with a seventh embodiment of the present invention, and FIG. 13 shows the bracket cover of FIG. 12. FIG. 14 shows a gated bracket cover which is applicable to a sound system of a wall-mounted flat panel display apparatus in accordance with the present invention.

In accordance with the seventh embodiment of the present invention, the bracket cover 40*a* can be manufactured to surround the mounting bracket 40*a* partially. That is, the bracket cover 40*a* can be a partially-open shape, in which a portion of the surrounding is open.

As one of good examples, the bracket cover 40*a* can be manufactured to surround the mounting bracket 15 in order to prevent the high-frequency sound from being reflected, but this is not necessary in other applications. For example, if the bracket cover 40*a* is mounted to allow its open part to be placed most distantly from the high-frequency speakers 20 and 20' as shown in FIG. 12, this can reduce the possibility that the high-frequency sounds outputted from the high-frequency speakers 20 and 20' are transferred to the open part. Accordingly, there can be no problem in accomplishing the purpose.

Instead, in case that the bracket cover 40*a* can be manufactured to have the partially-open shape, the mounting bracket 15 can be more conveniently fixed on the wall to mount the flat-panel display apparatus 10. A user can simply fix on the adjacent wall surface 19 through an open part of the bracket cover 40*a*.

With the similar purpose, the bracket cover can be manufactured to have a gated shape as shown in FIG. 14. One part of a bracket cover 40*b* in FIG. 14 is coupled to the other parts by a hinge (refer to "A" of FIG. 14), allowing the one part to open and close in the overall bracket cover. The gated bracket cover 40*b* can have two benefits, of which one is the convenience of fixing the mounting bracket 15 and the other is the complete blocking of the reflection of the high-frequency sound performed by surrounding the mounting bracket 15.

All the aforementioned bracket covers can be separately manufactured and attached to the back side of the flat-panel display apparatus in order to be mounted in the space between the back side and the wall. Alternatively, the bracket covers can be manufactured as one body in the case of the flat-panel display apparatus.

Although some embodiments of the present invention have been described, anyone of ordinary skill in the art to which the invention pertains should be able to understand that a very large number of permutations are possible without departing the spirit and scope of the present invention and its equivalents, which shall only be defined by the claims appended below.

What is claimed is:

1. A sound system of a wall-mounted flat panel display apparatus, the system comprising:

a speaker, being mounted in an area except for a display area, which plays back a video, in the flat panel display apparatus and playing back a corresponding sound; and an acoustic resonator, having a box shape including one surface formed with an open area and being mounted such that the surface formed with the open area is closely in contact with an outer side of a case of the flat panel display apparatus, the acoustic resonator being configured to induce a resonance of a sound projected from the speaker and inputted through the open area.

2. The sound system of claim 1, wherein the acoustic resonator is placed in a back side of the flat panel display apparatus to induce a resonance of a back sound projected in a direction of the back side of the flat panel display apparatus.

3. The sound system of claim 1, wherein the acoustic resonator is placed in at least one of left, right, upper and lower sides of the flat panel display apparatus.

4. The sound system of claim 1, wherein the acoustic resonator is formed with a hole for allowing the resonating sound to leak, the hole being formed on a surface except for a surface opposite to the surface having the open area.

5. The sound system of claim 4, wherein the acoustic resonator has a hexahedral box-shape, and the hole is formed in at least one of left, right, upper and lower surfaces of the acoustic resonator when viewed from the surface having the open area.

6. The sound system of claim 1, wherein the acoustic resonator has a rectangular parallelepiped shape, a horizontal or vertical length of the acoustic resonator is longer than a distance spaced between a back side of the flat panel display apparatus and a wall on which the flat panel display apparatus is to be mounted.

7. The sound system of claim 1, wherein, if the case of the flat panel display apparatus is formed with a hole for allowing a sound, projected from the speaker and passing through a space of the flat panel display apparatus, to leak to an outside, the acoustic resonator is mounted such that the open area covers the hole.

8. The sound system of claim 1, wherein, if the flat panel display apparatus includes at least two speakers that are mounted in different areas, the acoustic resonator is separately mounted per speaker.

9. The sound system of claim 1, wherein, if the flat panel display apparatus includes at least two speakers that function as each independent sound channel, the acoustic resonator is separately mounted per speaker.

10. A sound system of a wall-mounted flat panel display apparatus, the system comprising:

a speaker, being mounted in an area except for a display area, which plays back a video, in the flat panel display apparatus and playing back a corresponding sound; and an acoustic resonator, having a box-shaped appearance and being manufactured as one body with a case of the flat panel display apparatus, the acoustic resonator having one surface formed with an open area and the surface being in surface-contact with the case of the flat panel display apparatus, and the acoustic resonator being configured to induce a resonance of a sound projected from the speaker and inputted through the open area.

11. The sound system of claim 10, wherein the acoustic resonator is placed in a back side of the flat panel display apparatus to induce a resonance of a back sound projected in a direction of the back side of the flat panel display apparatus.

12. The sound system of claim 10, wherein the acoustic resonator is placed in at least one of left, right, upper and lower sides of the flat panel display apparatus.

13. The sound system of claim 10, wherein the acoustic resonator is formed with a hole for allowing the resonating sound to leak, the hole being formed on a surface except for a surface opposite to the surface having the open area.

14. The sound system of claim 13, wherein the acoustic resonator has a hexahedral box-shape, and the hole is formed in at least one of left, right, upper and lower surfaces of the acoustic resonator when viewed from the surface having the open area.

15. The sound system of claim 10, wherein the acoustic resonator has a rectangular parallelepiped shape, a horizontal or vertical length of the acoustic resonator is longer than a distance spaced between a back side of the flat panel display apparatus and a wall on which the flat panel display apparatus is to be mounted.

16. The sound system of claim 10, wherein, if the case of the flat panel display apparatus is formed with a hole for allowing a sound, projected from the speaker and passing through a space of the flat panel display apparatus, to leak to an outside, the acoustic resonator is mounted such that the open area covers the hole.

17. The sound system of claim 10, wherein, if the flat panel display apparatus includes at least two speakers that are mounted in different areas, the acoustic resonator is separately mounted per speaker.

18. The sound system of claim 10, wherein, if the flat panel display apparatus includes at least two speakers that function as each independent sound channel, the acoustic resonator is separately mounted per speaker.

19. A sound system of a wall-mounted flat panel display apparatus, the system comprising:

a speaker, being mounted in an area except for a display area, which plays back a video, in the flat panel display apparatus and playing back a corresponding sound; and an acoustic resonator, being manufactured in a pipe form having one end part that is open and the other end part that is closed and being mounted in an outer side of a case of the flat panel display apparatus, the acoustic resonator being configured to induce a resonance of a sound projected from the speaker and inputted through the open end part.

20. The sound system of claim 19, wherein the acoustic resonator is placed in a back side of the flat panel display apparatus to induce a resonance of a back sound projected in a direction of the back side of the flat panel display apparatus.

21. The sound system of claim 19, wherein the acoustic resonator is placed in at least one of left, right, upper and lower sides of the flat panel display apparatus.

22. The sound system of claim 19, wherein a distance between the one end part and the other end part of the acoustic resonator is longer than a distance between a back side of the flat panel display apparatus and a wall on which the flat panel display apparatus is mounted.

23. The sound system of claim 19, wherein the acoustic resonator is mounted such that the open end part is most adjacent to the speaker.

24. The sound system of claim 19, wherein, if the case of the flat panel display apparatus is formed with a hole for allowing a sound, projected from the speaker and passing through a space of the flat panel display apparatus, to leak to an outside, the acoustic resonator is mounted such that the open end part is most adjacent to the speaker.

25. The sound system of claim 19, wherein, if the flat panel display apparatus includes at least two speakers that are mounted in different areas, the acoustic resonator is separately mounted per speaker.

26. The sound system of claim 19, wherein, if the flat panel display apparatus includes at least two speakers that function as each independent sound channel, the acoustic resonator is separately mounted per speaker.

27. A sound system of a wall-mounted flat panel display apparatus, the system comprising:

a speaker, being mounted in an area except for a display area, which plays back a video, in the flat panel display apparatus and playing back a corresponding sound; and an acoustic resonator, being manufactured as one body with a case of the flat panel display apparatus and in a pipe form having one end part that is open and the other end part that is closed, and being configured to induce a resonance of a sound projected from the speaker and inputted through the open end part.

28. The sound system of claim 27, wherein the acoustic resonator is placed in a back side of the flat panel display apparatus to induce a resonance of a back sound projected in a direction of the back side of the flat panel display apparatus.

29. The sound system of claim 27, wherein the acoustic resonator is placed in at least one of left, right, upper and lower sides of the flat panel display apparatus.

30. The sound system of claim 27, wherein a distance between the one end part and the other end part of the acoustic resonator is longer than a distance between a back side of the flat panel display apparatus and a wall on which the flat panel display apparatus is mounted.

31. The sound system of claim 27, wherein the acoustic resonator is mounted such that the open end part is most adjacent to the speaker.

32. The sound system of claim 27, wherein, if the case of the flat panel display apparatus is formed with a hole for allowing a sound, projected from the speaker and passing through a space of the flat panel display apparatus, to leak to an outside, the acoustic resonator is mounted such that the open end part is most adjacent to the speaker.

33. The sound system of claim 27, wherein, if the flat panel display apparatus includes at least two speakers that are mounted in different areas, the acoustic resonator is separately mounted per speaker.

34. The sound system of claim 27, wherein, if the flat panel display apparatus includes at least two speakers that function as each independent sound channel, the acoustic resonator is separately mounted per speaker.

* * * * *